US011324979B2

(12) United States Patent
Inoue et al.

(10) Patent No.: US 11,324,979 B2
(45) Date of Patent: May 10, 2022

(54) FIRE EXTINGUISHER

(71) Applicant: Koatsu Co., Ltd., Hyogo (JP)

(72) Inventors: Yasufumi Inoue, Hyogo (JP); Mitsunori Kamo, Hyogo (JP)

(73) Assignee: KOATSU CO., LTD., Hyogo (JP)

( * ) Notice: Subject to any disclaimer, the term of this patent is extended or adjusted under 35 U.S.C. 154(b) by 0 days.

(21) Appl. No.: 16/307,630

(22) PCT Filed: Jun. 13, 2016

(86) PCT No.: PCT/JP2016/067562
§ 371 (c)(1),
(2) Date: Dec. 6, 2018

(87) PCT Pub. No.: WO2017/216851
PCT Pub. Date: Dec. 21, 2017

(65) Prior Publication Data

US 2019/0175967 A1 Jun. 13, 2019

(51) Int. Cl.
*A62C 13/76* (2006.01)
*A62C 13/64* (2006.01)
*A62C 99/00* (2010.01)

(52) U.S. Cl.
CPC ..... *A62C 13/76* (2013.01); *A62C 13/64* (2013.01); *A62C 99/0018* (2013.01)

(58) Field of Classification Search
CPC ..... A62C 13/76; A62C 13/64; A62C 31/02; A62C 99/0018; A62C 3/06; A62C 35/02; A62C 35/023
USPC ..... 169/74, 76
See application file for complete search history.

(56) References Cited

U.S. PATENT DOCUMENTS 2,580,419 A * 1/1952 Griggs ..... A62C 13/72 169/88
3,257,035 A * 6/1966 Dovaston ..... A62C 13/64 222/394
3,713,493 A * 1/1973 Hansen ..... F16K 1/303 169/75
3,741,310 A * 6/1973 Hansen ..... A62C 13/006 220/293

(Continued)

FOREIGN PATENT DOCUMENTS

JP H073667 U * 1/1995
JP 2001037904 A * 2/2001

*Primary Examiner* — Joseph A Greenlund
(74) *Attorney, Agent, or Firm* — Wenderoth, Lind & Ponack, L.L.P.

(57) ABSTRACT

In order to provide a portable fire extinguisher suitable for first-aid fire extinguishing, the fire extinguisher, using as the fire-extinguishing agent inert gas, etc. not limited in the object to be extinguished and the method of use due to toxicity to human body and making easy to maintain the necessary concentration of the fire-extinguishing agent, thus securing the effective fire-extinguishing effect, has the fire-extinguishing agent storage container to which the nozzle portion to discharge the fire-extinguishing agent is connected and made portable so as to be able to discharge the fire-extinguishing agent toward the object to be extinguished, and the nitrogen gas is stored in the fire-extinguishing agent storage container and at the outlet portion of the flow route of the fire-extinguishing agent formed in the nozzle portion, a metallic porous member in installed.

15 Claims, 14 Drawing Sheets

(56) References Cited

U.S. PATENT DOCUMENTS 4,420,047 A * 12/1983 Bruensicke ..... A62C 5/02 169/53
4,505,335 A * 3/1985 Hayba ..... B65D 83/202 222/402.15
4,567,948 A * 2/1986 Roznieck ..... A62C 13/64 222/402.1
4,646,848 A * 3/1987 Bruensicke ..... A62C 3/08 169/70
4,815,541 A * 3/1989 Arrington ..... B65D 83/206 222/402.11
5,857,525 A * 1/1999 Okamoto ..... A62C 35/02 169/11
6,886,640 B1 * 5/2005 Dushkin ..... B05B 1/26 239/323
7,143,775 B2 * 12/2006 Sundholm ..... F16K 17/1626 137/68.13
7,587,969 B2 * 9/2009 Silvers ..... F41A 21/30 42/1.06
8,151,896 B2 * 4/2012 Thompson ..... A62C 3/07 239/452
9,597,537 B2 * 3/2017 Inoue ..... A62C 31/02
10,258,816 B2 * 4/2019 Yabushita ..... B05B 1/002
2002/0083736 A1 * 7/2002 Kotliar ..... F17C 7/04 169/5
2005/0072463 A1 * 4/2005 Sundholm ..... A62C 35/023 137/68.3
2007/0044979 A1 * 3/2007 Popp ..... G01J 5/0014 169/56
2007/0068685 A1 * 3/2007 Arnott ..... A62C 3/06 169/30
2008/0078563 A1 * 4/2008 Hock ..... A62C 99/0018 169/49
2008/0128145 A1 * 6/2008 Butz ..... A62C 35/023 169/46
2009/0266643 A1 * 10/2009 Fukano ..... F04B 39/0033 181/258
2010/0132967 A1 * 6/2010 Yoshida ..... A62C 13/62 169/62
2011/0094758 A1 * 4/2011 Burkhart ..... A62C 35/68 169/17
2011/0139469 A1 * 6/2011 Garrett ..... A62C 3/07 169/46
2011/0214885 A1 * 9/2011 Mauney ..... A62C 31/05 169/30
2012/0205128 A1 * 8/2012 Goto ..... A62C 31/02 169/11
2012/0285705 A1 * 11/2012 Hill ..... A62C 99/0018 239/589
2013/0014964 A1 * 1/2013 Yoshida ..... A62C 99/0018 169/89
2013/0037277 A1 * 2/2013 Henry ..... B01F 25/45211 169/14
2013/0098639 A1 * 4/2013 Dunster ..... A62C 13/66 169/9
2013/0292140 A1 * 11/2013 Inoue ..... A62C 31/02 169/11
2014/0069663 A1 * 3/2014 Yabushita ..... A62C 31/02 169/37
2014/0263030 A1 * 9/2014 Weller ..... A62C 35/08 210/432
2016/0008647 A1 * 1/2016 Frasure ..... A62C 13/64 29/428
2018/0272166 A1 * 9/2018 Ahmadzadegan ..... A62C 99/0018
2019/0076683 A1 * 3/2019 Mchugh, IV ..... A62C 35/62
2019/0175967 A1 * 6/2019 Inoue ..... A62C 13/64

* cited by examiner

FIRE EXTINGUISHER

TECHNICAL FIELD

This invention concerns fire extinguishers, especially portable type or semi-fixed type fire extinguisher to be used for first-aid fire extinguishing.

BACKGROUND ART

Conventionally, as portable type or semi-fixed type fire extinguishers used for first-aid fire extinguishers, those using liquid and powder fire-extinguishing agents such as water fire extinguisher, foam fire extinguisher and powder fire extinguisher, have been generally used.

By the way, the fire extinguishers using liquid and powder as the fire-extinguishing agent have been widely used for extinguishing various types of fir because the nozzles and components such as fire-extinguishing agent container are simple in structure and easy for handling and storing.

But if such fire extinguishers using liquid and powder are used for fire-extinguishing, the liquid and powder are scattered to contaminate the surrounding environment and subsequent cleaning is troublesome, and therefore, they cannot be used for facilities installed with electric/electronic equipment such as computer, communication equipment, data center and electric equipment which hate contamination, because they would be destructively damaged.

For this reason, for such objects to be extinguished, fixed type fire extinguishing equipment using gas type fire-extinguishing agents such as carbon dioxide, halide and inert gas (inactive gas such as nitrogen gas and argon, individually or as mixture, same hereinafter) has been used (for example, see patent literature 1).

PRIOR ART LITERATURE

Patent literature

[Patent literature 1] Gazette No. JP 08-299492 A
[Patent literature 2] Gazette No. JP 5502157 B
[Patent literature 3] Gazette No. JP 3398624 B
[Patent literature 4] Gazette No. JP 3058841 B

OUTLINE OF INVENTION

Problems to be Solved by the Invention

By the way, the fixed type fire-extinguishing equipment using the gas-type fire-extinguishing agent was to fill the entire space of the facility where electrical/electronic equipment is installed, it was not always suitable for the first-aid fire extinguishing because subsequent cleaning trouble and cost are required.

If, for example, conventional all-area nitrogen gas fire-extinguishing equipment using nitrogen gas for fire-extinguishing is installed in a section of 1000 $m^3$, it requires 26 fire-extinguishing agent storage containers with the volume of 83 L, and when this system is started, it discharges all the fire-extinguishing agent storage containers to create the necessary fire-extinguishing agent concentration (flame reducing concentration), thereby fire-extinguishing. But once this system starts, it discharges all the fire-extinguishing agent storage containers even for a small fire which can be coped with through the first-aid fire extinguishing, and for this reason, the system was not always suitable for all the types of fire because it requires refilling and replacing troubles and costs.

On the other hand, as portable type or semi-fixed type fire extinguisher suitable for first-aid fire extinguishing using gas type fire-extinguishing agent, there exist those using carbon dioxide and halogenide, but the object to be extinguished and method of use are limited due to toxicity of the agent to human body and there is also a problem of halon control.

If a portable type or semi-fixed type fire extinguisher using inert gas as the fire-extinguishing agent uses, for example, nitrogen gas, a representative agent as the inert gas, it involves such problem that nitrogen gas is smaller in specific gravity and higher in concentration of the fire-extinguishing agent necessary for fire-extinguishing in comparison with other gas type fire-extinguishing agents such as carbon dioxide, and even when the nitrogen gas is discharged against an object to be extinguished, it quickly disperses making it difficult to be focused at the object and it is also difficult to maintain the necessary concentration of the fire-extinguishing agent because the discharged nitrogen gas is easily blown away by airflow making it difficult to secure the fire-extinguishing effect because it is immediately burned again if there is any fire cause, and therefore, it has not been put to practical use.

In consideration of the problems of the conventional portable type or semi-fixed type fire extinguishers used for first-aid fire extinguishing, the objective of this invention is to provide a portable type or semi-fixed type fire-extinguisher suitable for first-aid fire-extinguishing so as to secure an effective fire-extinguishing effect by using inert gases, etc. and making it easier to maintain the necessary concentration of the fire-extinguishing agent for fire-extinguishing, not limited to the object to be extinguished and the method of use due to toxicity to human body.

Means to Solve the Problems

In order to achieve the above objective, the fire extinguisher of this invention is a fire extinguisher with at least the nozzle portion made portable so as to be able to discharge the fire-extinguishing agent at the object to be extinguished, characterized in that the gas type fire-extinguishing agent as the aforementioned gas type fire-extinguishing agent is supplied through the supply means and a metallic porous member is arranged at the outlet portion of the agent flow route formed with in the aforementioned nozzle portion.

In this case, the aforementioned fire-extinguishing agent supply means consists of the fire-extinguishing agent storage container, and to the said fire-extinguishing storage container, the nozzle portion is rigidly connected and the fire-extinguishing agent storage container can be made portable.

The aforementioned extinguishing agent supply means consists of the extinguishing agent storage container, and to the storage container, the nozzle portion is connected via a flexible hose and the extinguishing agent storage container can be fixed.

In the flow route of the extinguishing agent from the aforementioned extinguishing agent supply means to the nozzle portion, an adjuster equipped with pressure-reducing function and/or flow-adjusting function can be provided.

The opening diameter of the aforementioned nozzle portion can be set 50 mm or larger.

The aforementioned nozzle portion can be formed by an aggregate of multiple nozzle portions.

As the aforementioned extinguishing agent, gas type extinguishing agent mainly consisting of inert gas can be used.

Effect of the Invention

According to the fire extinguisher of this invention, at least the nozzle portion is made portable so as to discharge the extinguishing agent toward the object to be extinguished, and as the aforementioned extinguishing agent, gas type agent is supplied from the extinguishing agent supply means, and at the outlet portion of the flow route of the agent formed in the aforementioned nozzle portion, a metallic porous member is arranged, and when the fire-extinguishing is done using the fire extinguisher, the extinguishing agent does not contaminate the surrounding environment, and while enjoying the characteristic of the inert gas, etc. not limited to the object to be extinguished and the method of use because of no toxicity to human body, thus making it possible for the extinguishing agent to go straight without dispersing and concentrate on the object to be extinguished and making it easy to maintain the necessary fire-extinguishing concentration, thereby making it possible to provide a portable or semi-fixed fire extinguisher suitable for first-aid fire extinguishing securing an effective fire-extinguishing effect.

The aforementioned fire-extinguishing agent supply means consists of the fire-extinguishing agent storage container, and to the said agent container, the nozzle portion is rigidly connected, and by making the fire-extinguishing agent container portable, it is made possible to provide an easy-to-use portable fire extinguisher suitable for first-aid fire extinguishing.

The aforementioned fire-extinguishing agent supply means consists of the fire-extinguishing agent storage container, ant to the said agent storage container, the nozzle portion is connected via a flexible hose, and the fire-extinguishing agent storage container is fixed, thereby making it possible to provide a semi-fixed fire extinguisher with large capacity suitable for first-aid fire extinguishing.

By providing an adjuster equipped with pressure reducing function and/or flow adjusting function in the flow route of fire-extinguishing from the aforementioned fire-extinguishing agent supply means to the nozzle position, it is possible to change the pressure (primary pressure) of the gas type fire-extinguishing agent mainly consisting of inert gas or nitrogen gas stored at high pressure in the fire-extinguishing agent storage container to easy-to-use pressure (secondary pressure) or maintain approximately constant the flow rate of the fire-extinguishing agent despite the pressure change, thus conducting stable fire-extinguishing.

By setting the opening diameter of the aforementioned nozzle portion 50 mm or larger, it is possible to set larger the range of maintaining the necessary fire-extinguishing concentration of the fire-extinguishing agent discharged toward the object to be extinguished.

By forming the aforementioned nozzle portion with an aggregate of multiple nozzle portions, it is possible to set larger the range of maintaining the necessary fire-extinguishing concentration of the fire-extinguishing agent discharged toward the object to be extinguished.

For the aforementioned fire-extinguishing agent, it is possible to appropriately use the gas type fire-extinguishing agent mainly consisting of inert gas.

BRIEF EXPLANATION OF DRAWINGS

FIGS. 2A-2C Showing the nozzle portion of the fire extinguisher, wherein FIG. 2A is an outside drawing of outside drawing as seen from the opening side, FIG. 2B is an outside drawing as seen from the connection side, and FIG. 2C is a X-X cross section.

FIGS. 11A-11C Explanatory drawing to show one example of the structure of the fire extinguisher, wherein FIG. 11A is an outside drawing as seen from the opening side, FIG. 11B is a Y-Y cross section of FIG. 11A, and FIG. 11C is an enlarged cross section of the nozzle portion.

FIGS. 12A-12C Explanatory drawing to show one example of the structure of the fire extinguisher, wherein FIG. 12A is an outside drawing as seen from the opening side, FIG. 12B is a Z-Z cross section of FIG. 12A, and FIG. 12C is an enlarged cross section of the nozzle portion.

DETAILED DESCRIPTION OF PREFERRED EMBODIMENTS

The following describes the implementation forms of the fire extinguisher of this invention in accordance with the drawings.

Figure 1:
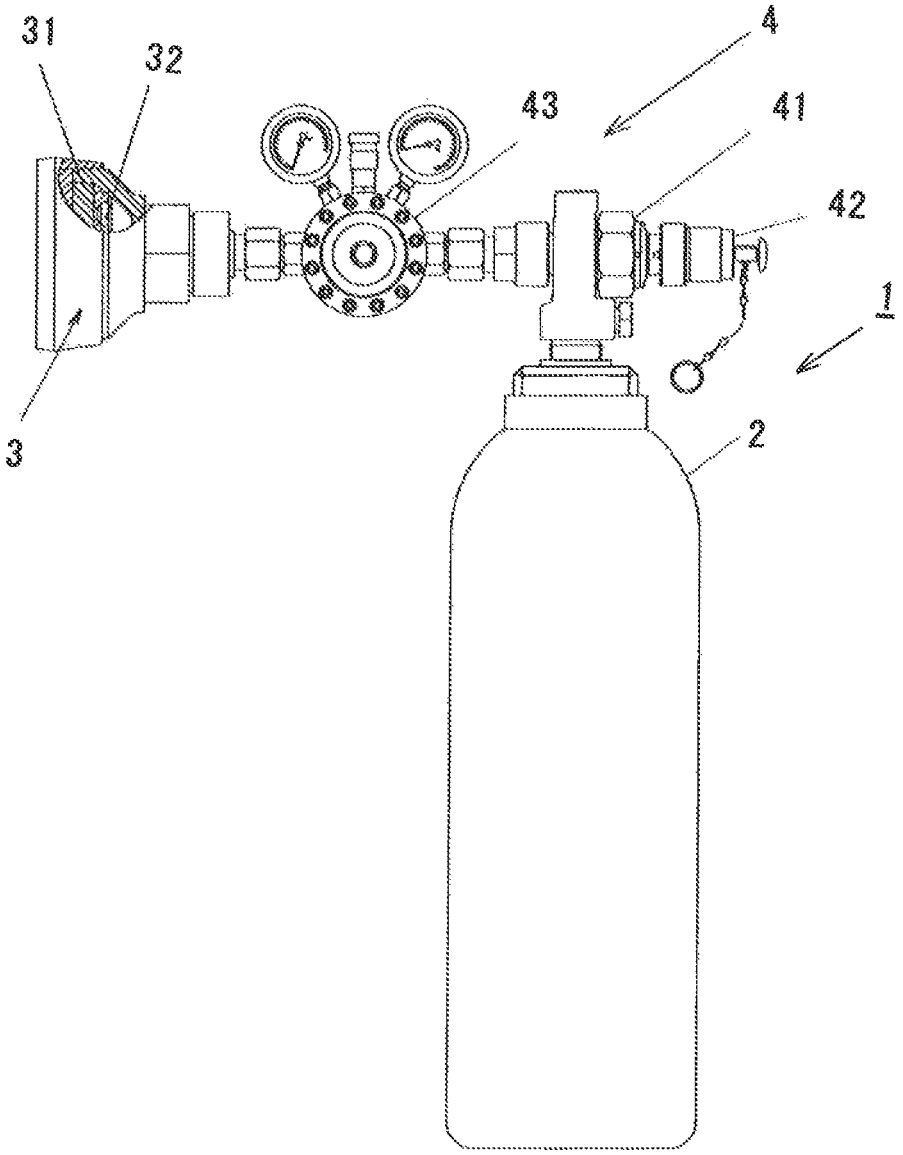
FIG. 1 Explanatory drawing to show Embodiment 1 of the fire extinguisher of this invention.
Figure 2C:
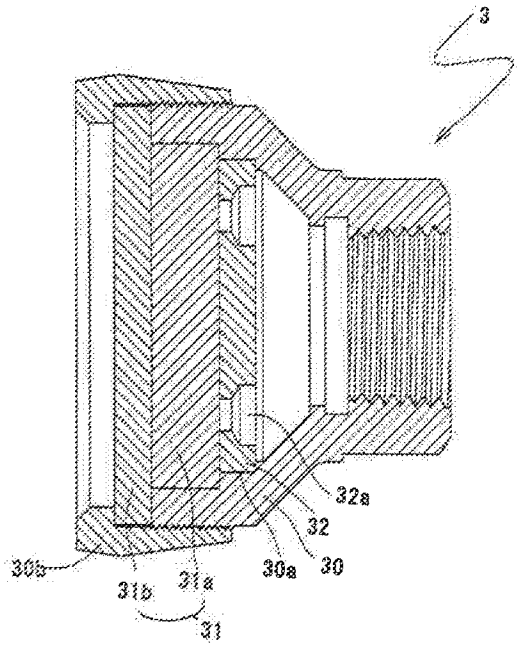
Figure 2B:
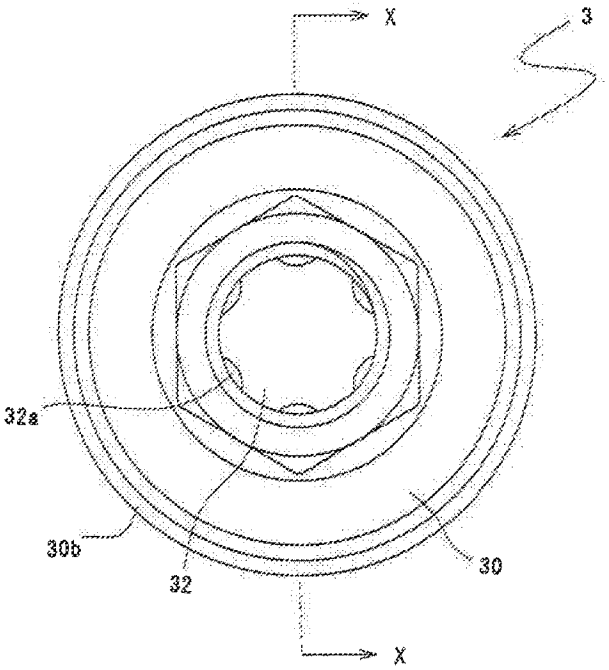
Figure 2A:
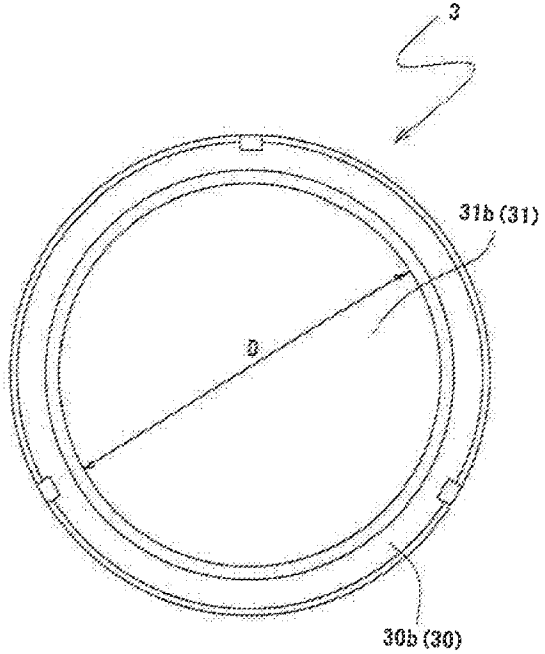

FIG. 1 and FIG. 2 show Embodiment 1 of the fire extinguisher of this invention.

This fire extinguisher 1 uses nitrogen gas representative as inert gas (as the fire-extinguishing gas, various types of inert gas mixing multiple types of inert gas including argon and nitrogen gas can also be used) and has the fire-extinguishing agent supply container 2 made portable as the fire-extinguishing agent supply means to which nozzle portion 3 connected so as to make it possible to discharge the fire-extinguishing agent toward the object to be extinguished and the nitrogen gas stored in the fire-extinguishing agent storage container 2 and a metallic porous member 31 arranged at the outlet portion of the fire-extinguishing agent flow route formed in the nozzle portion 3.

In this case, the fire-extinguishing agent storage container 2 and nozzle portion 3 are rigidly connected via controller 4 to control discharging of the fire-extinguishing agent generally used by the fire-extinguisher and fire-extinguishing equipment to use the gas type fire-extinguishing agent including container valve 41, opening device 42 and adjuster 43.

Here the adjuster 43 is preferably equipped with a pressure-reducing function to change the pressure (primary pressure) of the nitrogen gas stored at high pressure in the fire-extinguishing agent storage container 2 to an easy-to-use pressure (secondary pressure), pressure regulating function to keep constant the secondary pressure, and a flow control function for stable fire-extinguishing by holding approximately constant the flow of the fire-extinguishing agent despite a pressure change of the agent, and for this purpose, for example, it is possible to properly use the constant flow valve proposed previously by this applicant (see Patent Literature 2).

It is not always necessary to rigidly connect the fire-extinguishing agent storage container 2 and nozzle portion 3 and it is, for example, also possible to connect the nozzle portion 3 to the fire-extinguishing agent container 2 via a flexible tube.

Here, in order to provide a portable fire extinguisher suitable for first-aid fire extinguishing using nitrogen gas as the fire-extinguishing agent, this fire extinguisher 1 uses for the nozzle portion 3 to discharge the fire-extinguishing agent a nozzle portion 3 shown in FIG. 2 capable of discharging the fire-extinguishing agent straight in a concentrated way toward the object to be extinguished without dispersing.

The nozzle portion 3 is composed of nozzle body 30 connected to the piping on the side of the extinguishing agent storage container 2, orifice plate 32 with multiple orifices 32*a* (6 pcs. in this embodiment) installed removal to the step portion 30*a* formed in the inside space of the nozzle body, block-shaped metallic porous member 31 through which gas can pass, installed at the outlet portion of the orifice 32*a*, and ring member 30*b* to support the metallic porous member 31 to the nozzle body 30 in contact with the peripheral portion on the end face on the side opened into the atmosphere.

The orifice plate 32 forming multiple orifices 32*a* is installed removal to the step portion 30*a* formed in the inside space of the nozzle body 30, for example, via threads formed on the peripheral face of the step portion 30*a* and orifice plate 32.

This makes it possible to select the orifice 32 forming multiple types of orifices 32*a* in accordance with the use conditions.

It is possible to omit the orifice plate 32 and instead directly form the similar orifice to the nozzle body 30 (illustration omitted).

For the orifice 32*a*, it is preferable to form in such a way that the smaller diameter side of the orifice 32*a* faces the metallic porous member 31.

Thus the nitrogen gas is uniformly passed from the center portion of the metallic porous member 31 toward the peripheral portion thus making it possible for the nitrogen gas to be uniformly discharged from the entire surface of the end face opened into the atmosphere of the metallic porous member 31.

The metallic porous member 31 can have an integral structure, and in addition, it can have a divided structure consisting of upstream member 31*a* and lower stream member 31*b* as shown in this embodiment.

For the metallic porous member 31, it can suitably be possible to use a sintered body or three-dimensional mesh structure consisting of inorganic material with high shape-holding performance (metal, metallic oxide, metallic hydroxide, etc.).

For the hole diameter of void of the material to form the metallic porous member 31, material homogenous throughout the body is used and it is changed in the gas flowing direction, more specific, material to become smaller in the gas flowing direction can be used, for example, the void hole diameter of the downstream side member 31*b* being smaller than that of the upstream side member 31*a*.

By making the void hole diameter of the material to form the metallic porous member 31 smaller in the gas flowing direction, it is possible to uniformly discharge the nitrogen gas from the entire end face surface opened into the atmosphere of the metallic porous member 31.

For the metallic porous member 31, either the integral structure or divided structure, the end face opposite to the side opened into the atmosphere of the metallic porous member 31 is set in contact with the nozzle body 30 (including orifice plate 32 in this embodiment) and the end face on the side opened into the atmosphere is supported by the nozzle body 30 via the ring member 30*b* in contact with the peripheral portion of this end face.

In this case, the ring member 30*b* is installed removal to the nozzle body 30 via threads formed on the peripheral face of the nozzle body 30 and ring member 30*b*.

The downstream side member 31*b* to form the metallic porous member 31 is made larger in diameter than the upstream side member 31*a* and the peripheral edge portion of this downstream side member 31*b* is fixed between the end face of the nozzle body 30 and the edge portion of the ring member 30*b*, thus making it possible to enlarge the opening area (opening diameter) opened into the atmosphere of the metallic porous member 31 (downstream side member 31*b*) and large the range to maintain the necessary fire-extinguishing agent concentration of the nitrogen gas discharged toward the object extinguished.

Since the size of the opening area (opening diameter) opened into the atmosphere of the metallic porous member 31 is to determine the range (several times the opening area) to maintain the necessary fire-extinguishing agent concentration of the nitrogen gas for fire extinguishing, the opening diameter is set to be 50 mm or larger, preferably 70 mm or larger, and more preferably 100 mm.

When this fire extinguisher 1 is used, the fire-extinguishing agent does not contaminate the surrounding environment, and if it uses inert gas (nitrogen gas) having no toxicity to human body, it is not limited in the object to be extinguished and the method of use, and the fire-extinguishing agent discharged toward the object to be extinguished goes straight without dispersing and can be discharged in a concentrated way toward the object, making it easy to maintain the necessary fire-extinguishing agent concentration, thus securing effective fire-extinguishing effect, thus providing a portable fire extinguisher especially useful for the first-aid fire extinguishing.

The following explains specifications and actions of this fire extinguisher.

Weight of the fire-extinguishing agent storage container (including nozzle portion): about 17 kg Weight of nitrogen gas filled: about 4 kg Filling pressure of nitrogen gas: about 30 MPa Discharging duration of nitrogen gas: about 15 seconds Distance to object to be extinguished: within about 2 m Range to maintain necessary fire-extinguishing agent concentration of nitrogen gas for fire extinguishing: several times the opening area opened into the atmosphere of the metallic porous member (downstream side member) (opening diameter D of metallic porous member of this embodiment: about 100 mm)

Figure 3:
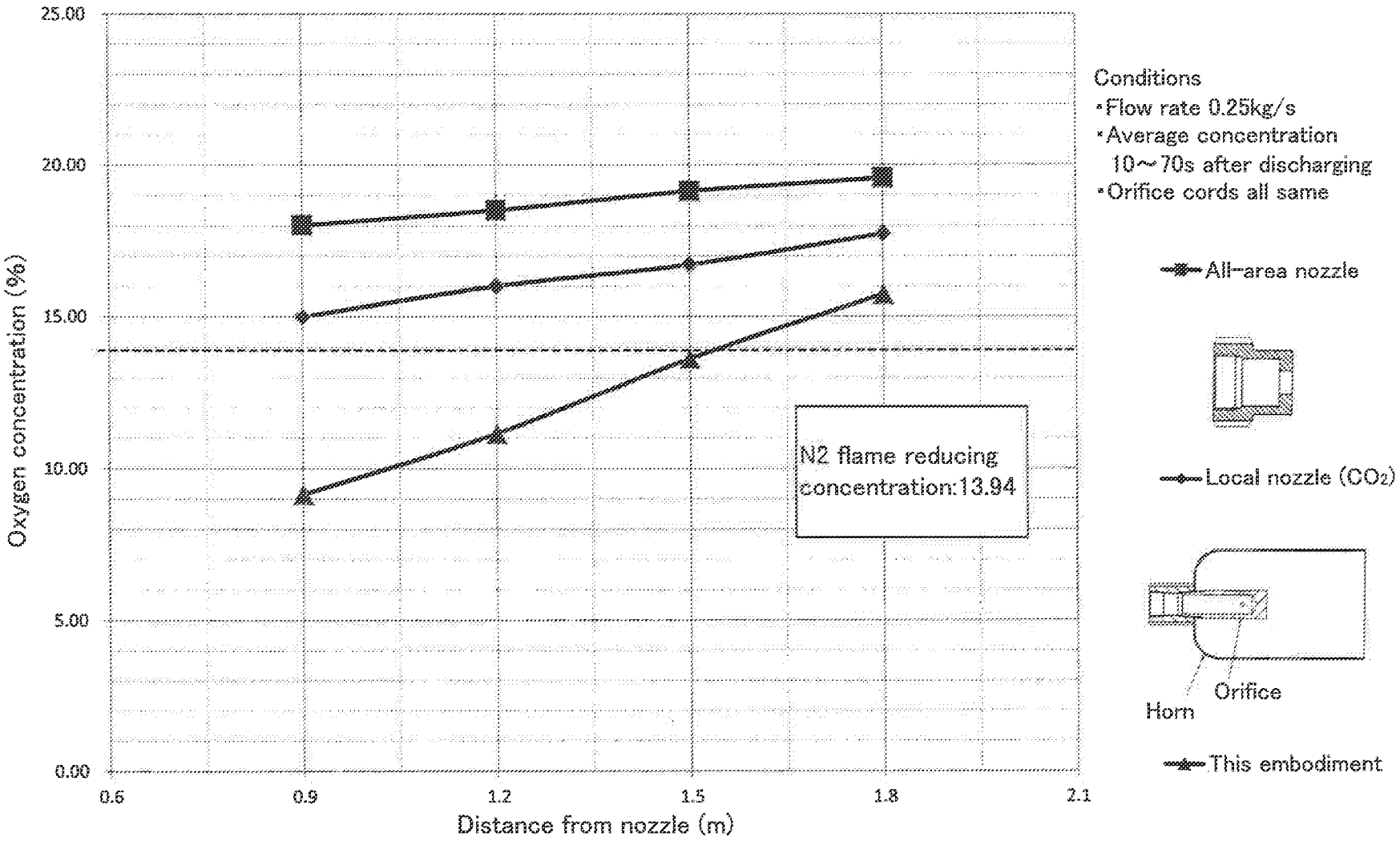
FIG. 3 Graph to show results of measuring the relationship between distance from the nozzle and oxygen concentration when various nozzles are used.

Metallic porous member: porous metallic body consisting of three-dimensional mesh structure "Celmet" (registered trade name) made by Sumitomo Electric Industries FIG. 3 shows measured results of relationship between the distance from the nozzle when various nozzles are used and oxygen concentration on the center axis in radial direction of fire-extinguishing agent (nitrogen gas) of the nozzle.

Here the all-area nozzle has one small hole formed at the tip of the nozzle to discharge the fire-extinguishing agent (nitrogen gas) toward the object, and the local nozzle, often used for carbon dioxide, has multiple small holes formed horizontally at the tip of the nozzle, and the entire tip portion of the nozzle is covered by the horn, and from the tip opening of the horn the fire-extinguishing agent (nitrogen gas) is discharged toward the object to be extinguished.

As clear from FIG. 3, with the nozzle of this embodiment, it is confirmed that it is possible to maintain the necessary fire-extinguishing agent concentration (extinguishing concentration) for fire extinguishing in the range of 1 to 1.5 m of distance to the object to be extinguished, which was difficult with the all-area nozzle and local nozzle (it is possible to expand the range by increasing the opening diameter D of the metallic porous member (downstream side member).

Figure 4:
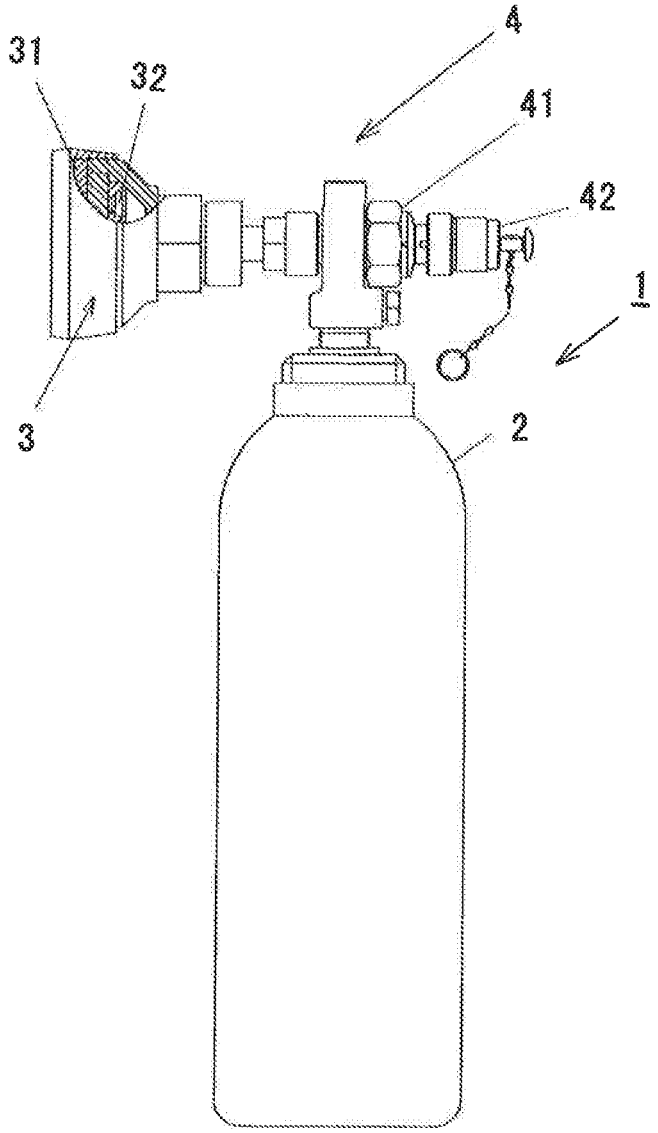
FIG. 4 Explanatory drawing to show modification of embodiment 1 of the fire extinguisher of this invention.

With the above fire extinguisher 1 of Embodiment 1, the nitrogen gas stored at high pressure in the fire-extinguishing agent storage container 2 is reduced in pressure by the nozzle portion 3 provided with the fire-extinguishing agent container 2 and orifice 32*a*, and therefore, the adjuster 43 of the controller 4 can be omitted as shown in the modification of Embodiment 1 of the fire extinguisher of this invention shown in FIG. 4 by adjusting the pressure (primary pressure) of the nitrogen gas stored in the fire-extinguishing agent storage container 2 and the metallic porous member 31 and orifice 32*a* provided for the nozzle portion 3.

Figure 5:
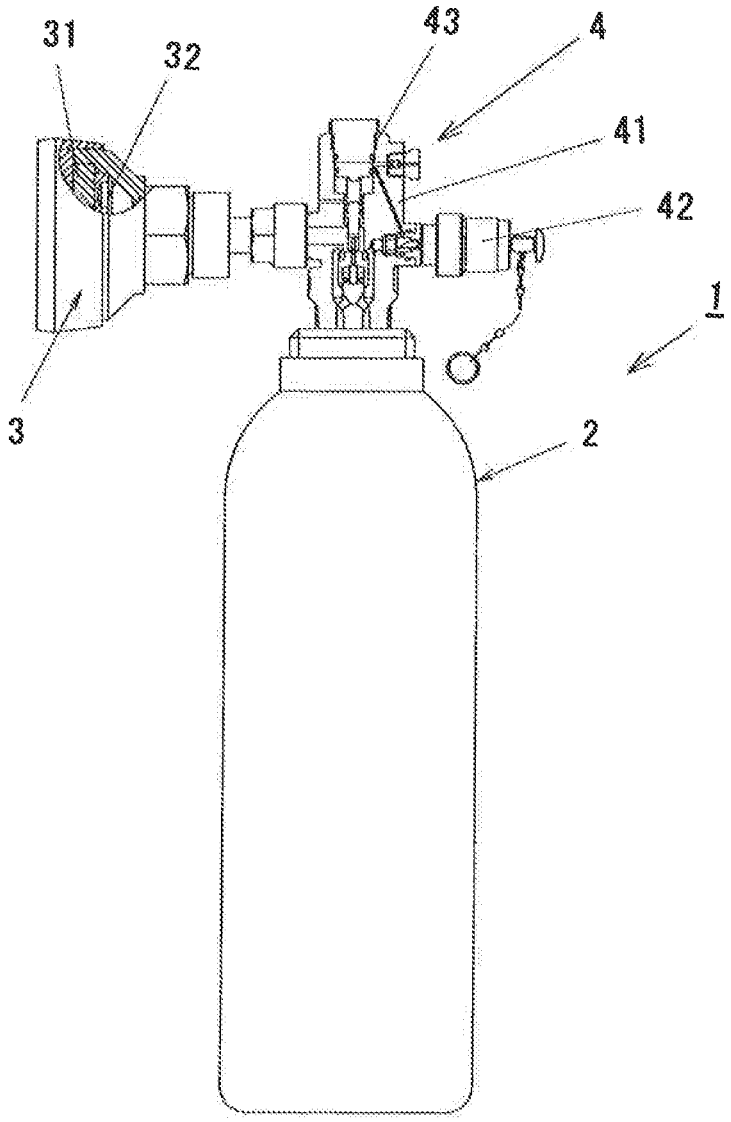
FIG. 5 Explanatory drawing to show Embodiment 2 of the fire extinguisher of this invention.

FIG. 5 shows Embodiment 2 of the fire extinguisher of this invention. With this fire extinguisher, of the controller 4 to control discharging of the fire-extinguishing agent externally attached to the agent storage container 2 in the above fire extinguisher 1 of Embodiment 1, the adjuster 43 having the pressure reducing function to change the pressure (primary pressure) of the nitrogen gas stored at high pressure in the agent storage container 2 to easy-to-use pressure (secondary pressure), pressure control function to keep approximately constant the secondary pressure and flow control function to hold approximately constant the flow rate of the fire-extinguishing agent despite pressure change so as to conduct stable fire-extinguishing, is incorporated in the container valve 41.

This container valve 4 is preferably equipped with pressure reducing function to change the pressure (primary pressure) of the nitrogen gas stored in the agent storage container 2 to easy-to-use pressure (secondary pressure), pressure control function to keep constant the secondary pressure and flow control function to keep approximately constant the flow rate of the fire-extinguishing agent despite pressure change of the agent for stable fire-extinguishing, and for example, the pressure-reducing type container valve for gas type fire-extinguishing equipment previously proposed by this patent applicant can be properly used.

This eliminates the projection of the fire extinguisher 1 because the adjuster 43 is not externally exposed, thereby making it possible to enhance the operability and safety.

In this case, the adjuster 43 is made to function interlocking with the opening device 42 also incorporated in the container valve 41.

Figure 6:
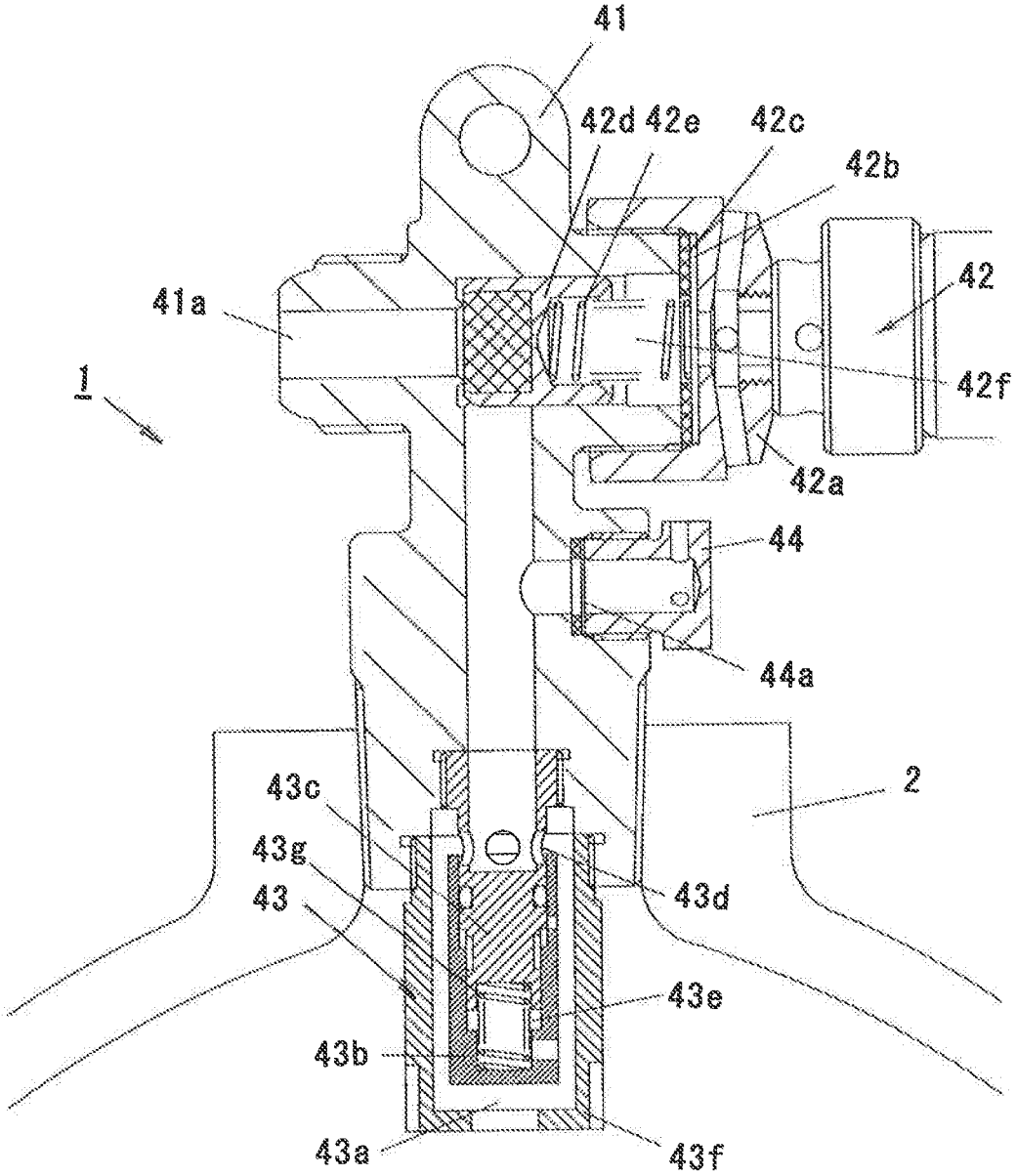
FIG. 6 Explanatory drawing to show internal structure of the fire extinguishing agent storage container and container valve of Embodiment 3 of the fire extinguisher of this invention.

FIG. 6 shows Embodiment 3 of the fire extinguisher of this invention.

With this fire extinguisher, of the controller 4 to control discharging of the fire-extinguishing agent externally attached to the agent storage container 2 in the above fire extinguisher 1 of Embodiment 1, the adjuster 43 having the pressure-reducing function to change the pressure (primary pressure) of nitrogen gas stored at high pressure in the agent storage container 2 to easy-to-use pressure (secondary pressure), pressure control function to keep constant the secondary pressure and flow control function to keep approximately constant the flow rate of the fire-extinguishing agent despite pressure change for stable fire-extinguishing is housed in the agent storage container 2.

This eliminates the projection of the fire extinguisher 1 because the adjuster 43 is not externally exposed, thereby making it possible to enhance the operability and safety and also stability when the fire extinguisher 1 is set erect because the center of gravity is lowered.

In this case, the adjuster 43 is incorporated in the container valve 41 and housed in the agent storage container 2 so as to function interlocking with the opening device 42 also incorporated in the container valve 41.

The container valve 41 also incorporates a safety valve 44 equipped with sealing plate 44*a* to discharge the nitrogen gas when the pressure of the nitrogen gas stored in the storage container 2 rises abnormally high.

The opening device 42 incorporated in the container valve 41 is equipped with the sealing plate 42*b* installed via the seal member 42*c* by cap nut 42*a* spirally fit to the container valve 41 and the opening/closing valve 42*d*, which is energized to close the gas flow route following the tip opening portion 41*a* of the container valve 41 by means of the spring member 42*e*, rear end of which is supported by the cap nut 42*a*.

The opening/closing valve 42*d* is applied on its back with the pressure of nitrogen gas stored in the agent storage container 2 in the valve chamber 42*f*.

When the fire extinguisher 1 is placed in the storing position, the gas flow route following the tip opening portion 41*a* of the container valve 41 is closed by the opening/closing valve 42*d*, thus making it possible to keep the storing condition of the nitrogen gas stored at high pressure in the agent storage container 2.

When the fire extinguisher 1 is used, the sealing plate 42*b* is broken to lower the pressure in the valve chamber 42*f*, thereby breaking the pressure balance of the nitrogen gas applied on the opening/closing valve 42*d* and the opening/closing valve 42*d* moves against the energizing force of the spring member 42*e* to open the gas flow route following the tip opening portion 41*a* of the container valve 41 to discharge the nitrogen gas.

The adjuster 43 consists of a constant flow valve to change the sectional area of the flow route opening portion 43*d* formed along the moving direction of the valve body 43*b* of the valve support 43*c* installed fixed to the valve body 43*b* to the flow route 43*a* of the nitrogen gas by installing the valve body 43*b* movable to the flow route 43*a* of the nitrogen gas.

Here, the pressure-receiving area of the face facing the upstream side of the valve body 43*b* subjected to the static pressure of the nitrogen gas before pressure is reduced by change in sectional area of the flow route opening portion 43*d* is made equal to the pressure-receiving area of the face facing the downstream side (for this reason, the gas pressure chamber 43*e* formed in the valve body 43*b* is communicated with the nitrogen gas flow route 43*a* by means of the passage 43*f* formed in the valve body 43*b*), and by eliminating the face facing the upstream side of the valve body 43*b* subjected to the static pressure of the nitrogen gas after pressure reducing and the face facing the downstream side, the force due to the static pressure of the nitrogen gas applied in the moving direction of the valve body 43*b* is balanced and the force applied to the valve body 43*b* due to the flow of nitrogen gas is balanced with the energizing force of the spring member 43*g* to energize the valve body 43*b* in the direction to balance with this force, thereby changing the sectional area of the flow route opening portion 43*d* formed along the moving direction of the valve body 43*b* of the valve body support 43*c* so that the flow rate of the nitrogen gas is kept constant regardless of the pressure change of the nitrogen gas.

According to the adjuster 43 consisting of this constant flow valve, the valve body 43*b* installed in the passage 43*a* of the nitrogen gas is operation-balanced by the force applied to the valve body 43*b* and the energizing force of the spring member 43*g*, thus changing the sectional area of the flow route opening portion 43*d* so that the flow rate of the nitrogen gas can be kept approximately constant regardless of the pressure change of the nitrogen gas.

This makes it possible to cope with a large flow rate, less affected by the pressure change of the nitrogen gas.

As an energizing means to energize the valve body 43*b* in the direction to balance with the force applied on the valve body 43*b*, the spring member 43*g* is used (magnet can also be used), thereby making possible to make the entire structure simple and house the adjuster 43 in the agent storage container 2.

Furthermore, this adjusted 43 functions interlocking with the opening device 42 incorporated in the container valve 41, thus making possible to simplify the mechanism and operation of the controller 4 to control discharging of the extinguishing agent including the adjuster 43 and opening device 41 and to enhance the reliability.

Figure 7:
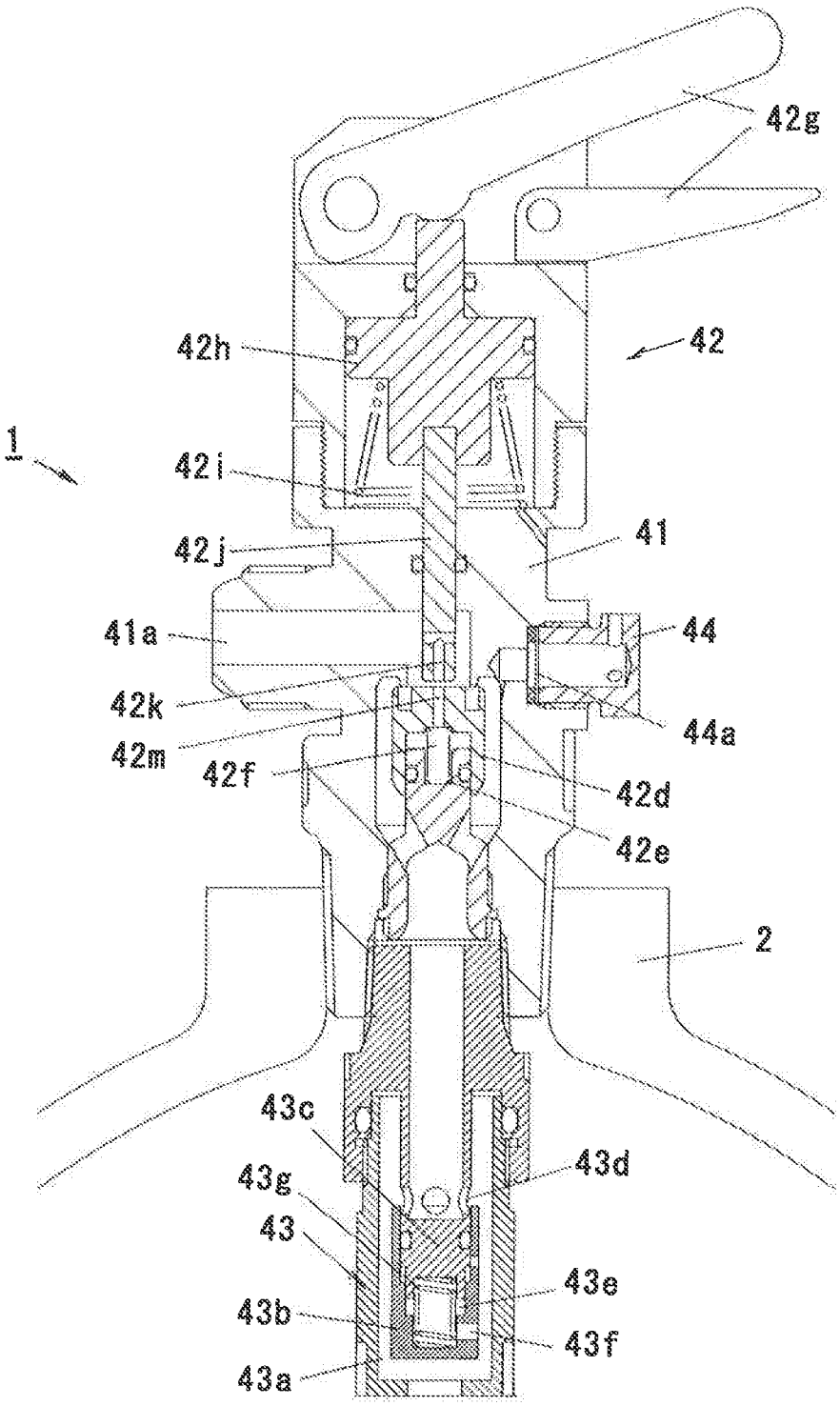
FIG. 7 Explanatory drawing to show internal structure of fire-extinguishing agent storage container and container valve of modification of Embodiment 3 of the fire extinguisher of this invention.

FIG. 7 shows modification of Embodiment 3 of the fire extinguisher of this invention.

With this fire extinguisher 1, the opening device 42 incorporated in the container valve 41 in the above fire extinguisher 1 of Embodiment 3 is modified, and the container valve 41 is equipped with handle 42*g*, operating valve 42*h* to be operated against the energizing force of the spring member 42*e* by this handle 42*g*, operating rod 42*j* provided integral with the operating valve 42*h* and opening/closing 42*d*, and the opening/closing member 41*a* is energized in the direction to close the gas flow route following the tip opening portion 41 of the container valve 41 by the spring member 42*e*.

For the operating rod 42*j* and opening/closing valve 42*d*, the passages 42*k* and 42*m* are formed so that the pressure on the tip opening portion 41*a* side of the container valve 41 is applied in the valve chamber 42*f*.

When the fire extinguisher is placed in the storing position, the gas flow route following the tip opening portion 41*a* of the container valve 41 is closed by the opening/closing valve 42*d* and the storing condition of the nitrogen gas stored at high pressure in the agent storage container 2 can be kept.

When the fire extinguisher 1 is used on the other hand, the opening/closing valve 42*d* is moved via the operating valve 42*h* and operating rod 42*j* by operating the handle 42*g*, thereby the gas flow route following the tip opening portion 41*a* of the container valve 41 is moved and the gas route following the tip opening portion 41*a* of the container valve 41 is opened to discharge the nitrogen gas. Here, even if the operation of the handle 42*g* is released, the moving position of the opening/closing valve 42*d* is maintained through balancing of the nitrogen gas pressure applied on the opening/closing valve 42*d*.

Other composition and action involving the adjuster 43 of this embodiment are same as those of the above fire extinguisher 1 of Embodiment 3.

Figure 8:
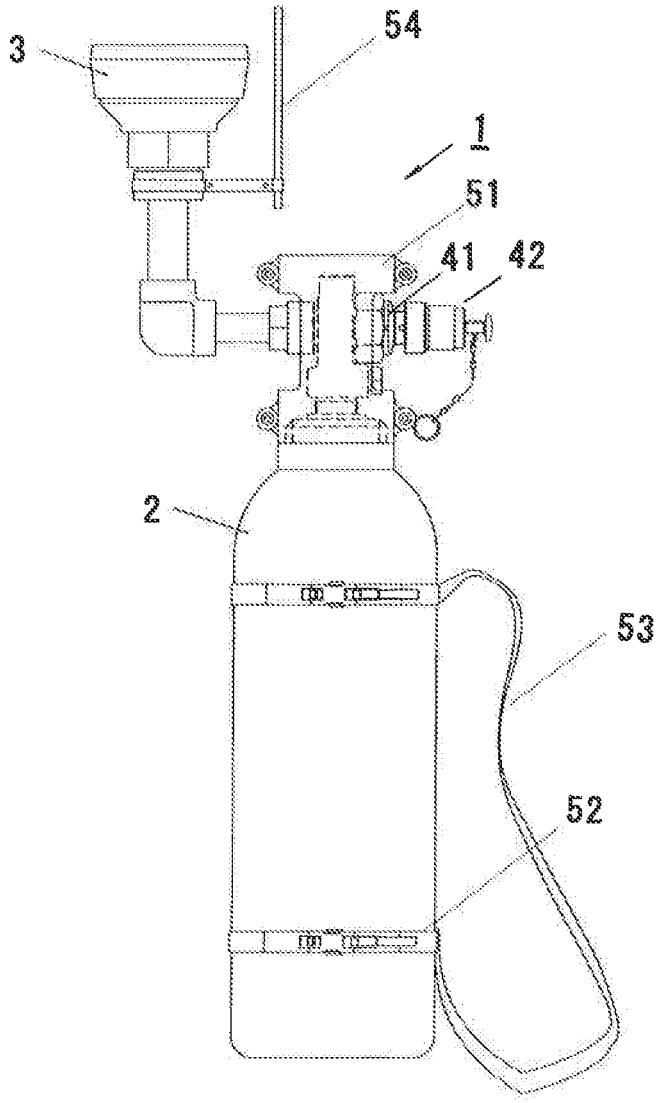
FIG. 8 Explanatory drawing to show modification of Embodiment 3 of the fire extinguisher of this invention.

FIG. 8 shows modification of Embodiment 3 of the fire extinguisher of this invention.

This fire extinguisher 1 is provided with a protector 51 to protect the portion externally exposed from the agent storage container 2 of the fire extinguisher 1, fixing band 42 as a holding member of the agent storage container 2, shouldering device 53, and discharging direction indicator 54.

This can further enhance the operability and safety of the fire extinguisher 1.

Figure 9:
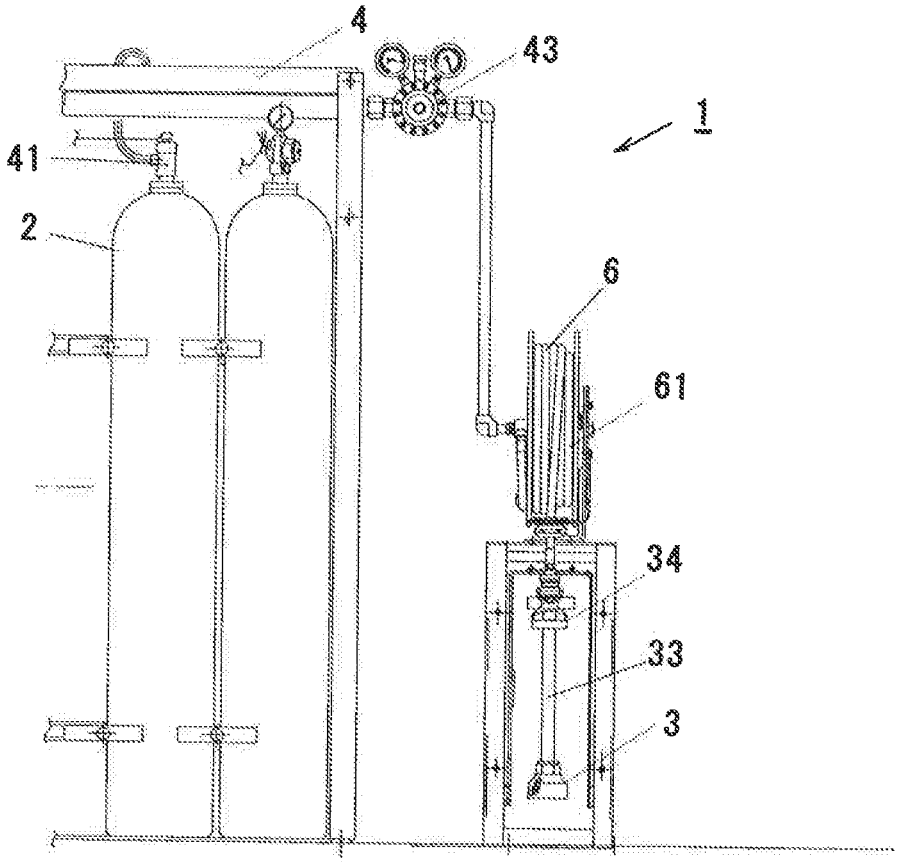
FIG. 9 Explanatory drawing to show Embodiment 4 of the fire extinguisher of this invention.
Figure 9:
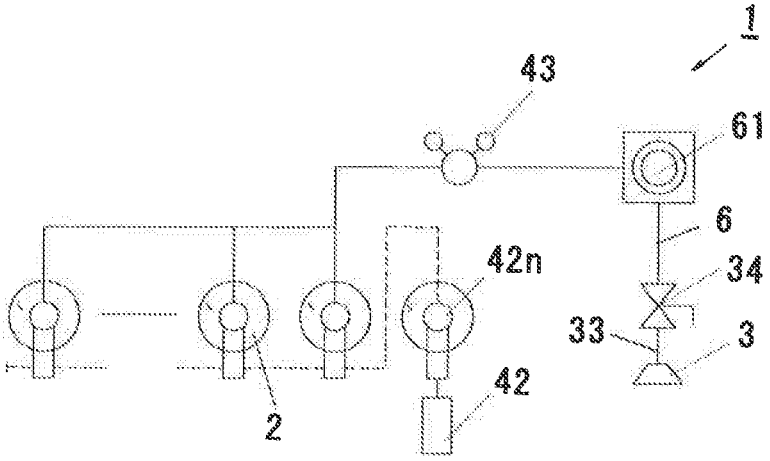

FIG. 9 shows Embodiment 4 of the fire extinguisher of this invention.

For this fire extinguisher 1, the nozzle 3 is connected to the agent storage container 2 as an agent supply means via a flexible hose 6 and the agent storage container is installed fixed, and as the above fire extinguisher 1 of Embodiment 1, the nitrogen gas is stored in the agent storage container 2, and at the outlet portion of the flow route of fire-extinguishing agent formed in the nozzle 3, the metallic porous member 31 is installed.

Here, the hose 6, a necessary length, is wound on the hose reel 61 and pulled out for using, and the holding portion 33 of the nozzle portion 3 is provided with the opening/closing valve 34 so that the hydrogen gas can be discharged or stopped at hand.

This makes it possible to provide a semi-fixed type fire extinguisher of large capacity suitable for first-end fire extinguishing.

The following explains the specifications of this fire extinguisher 1.

Weight of nozzle portion (including the holding portion and hose): about 15 kg

Filling pressure of nitrogen gas: about 30 MPa

Discharging duration of nitrogen gas: about 30 seconds (per one agent storage container)

Distance to the object to be extinguished: within 2 m

Figure 10:
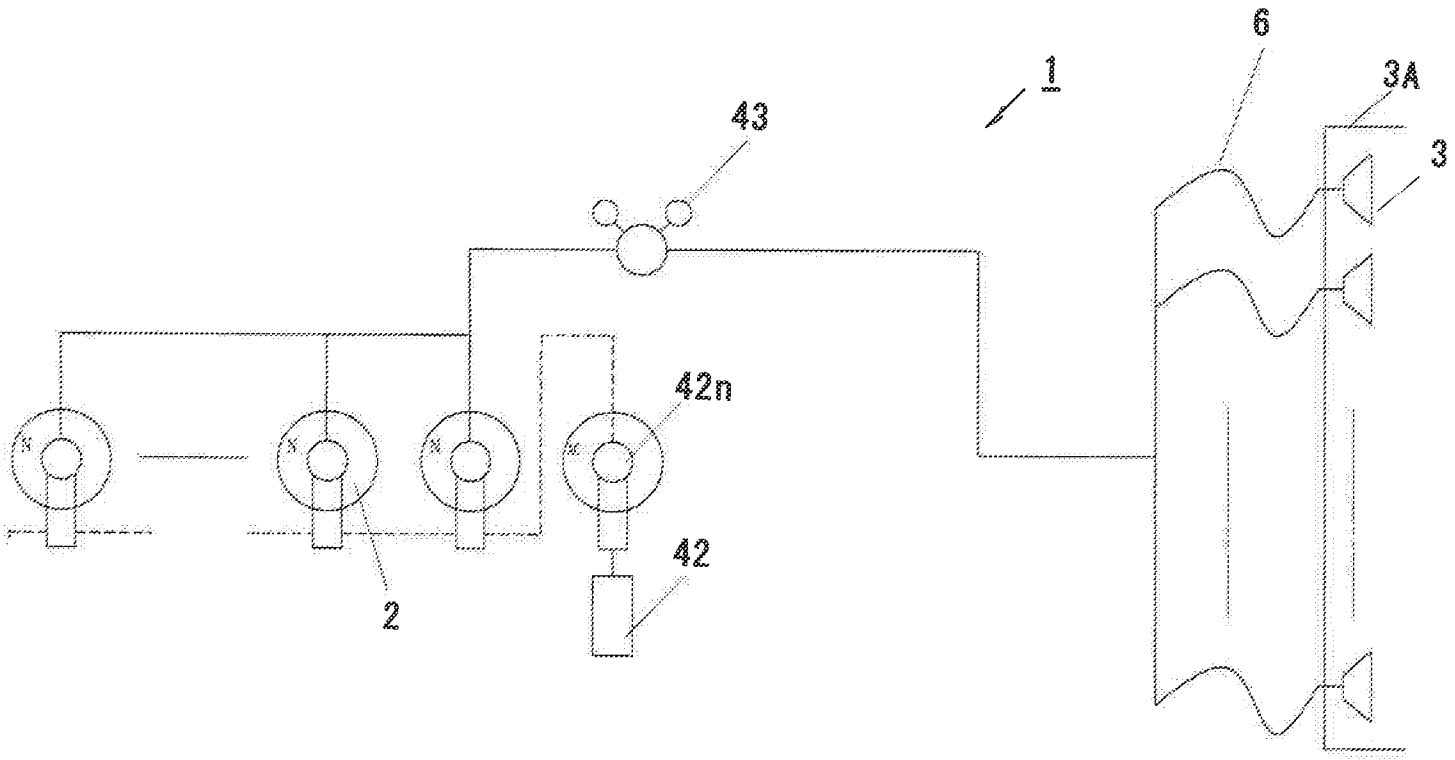
FIG. 10 Explanatory drawing to show Embodiment 5 of the fire extinguisher of this invention.
Figure 11C:
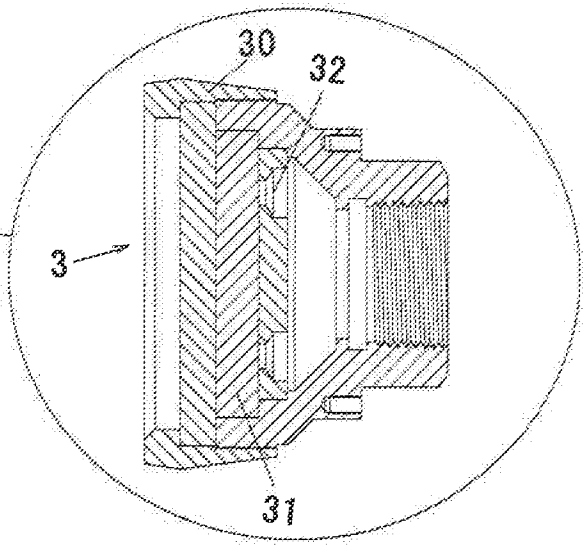
Figure 11B:
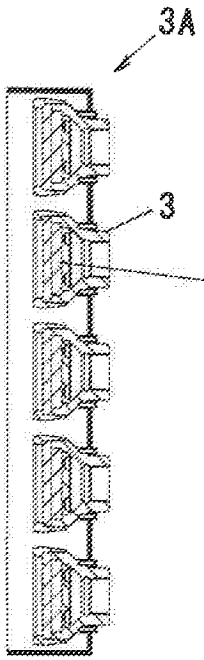
Figure 11A:
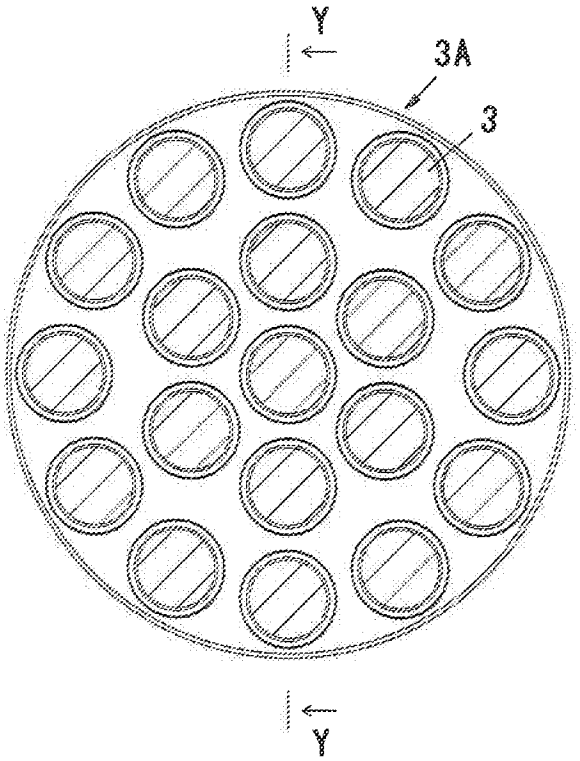

FIGS. 10 and 11 show Embodiment 5 of the fire extinguisher of this invention.

This fire extinguisher 1 has nozzle portion 3A formed as an aggregate of nozzle portion 3 using multiple pieces of nozzle portion 3.

This makes it possible to set larger the range to maintain the necessary concentration for fir extinguishing of the fire-extinguishing agent to be discharged toward the object to be extinguished.

In this case, since the weight of the nozzle portion 3A is heavy, it is possible to adopt an optional power supplemental mechanism to reduce the load during operation.

Figure 12C:
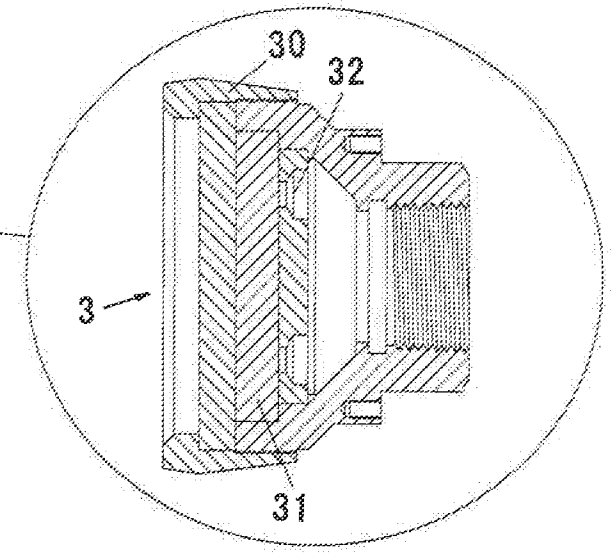
Figure 12B:
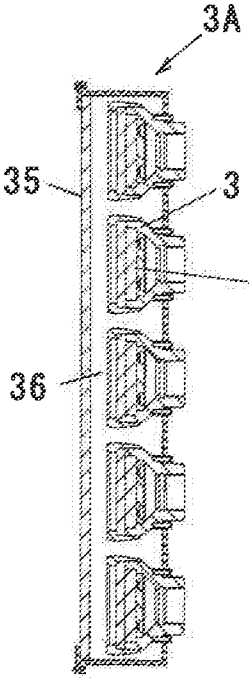
Figure 12A:
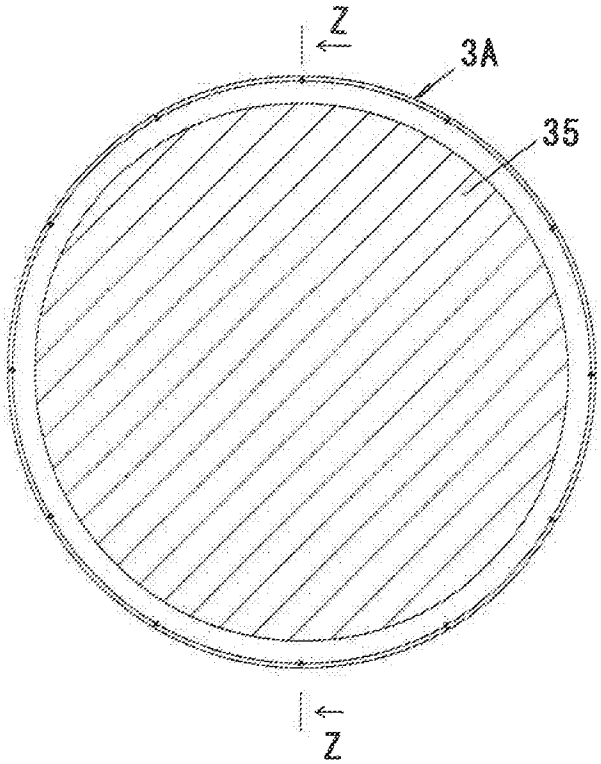
Figure 13:
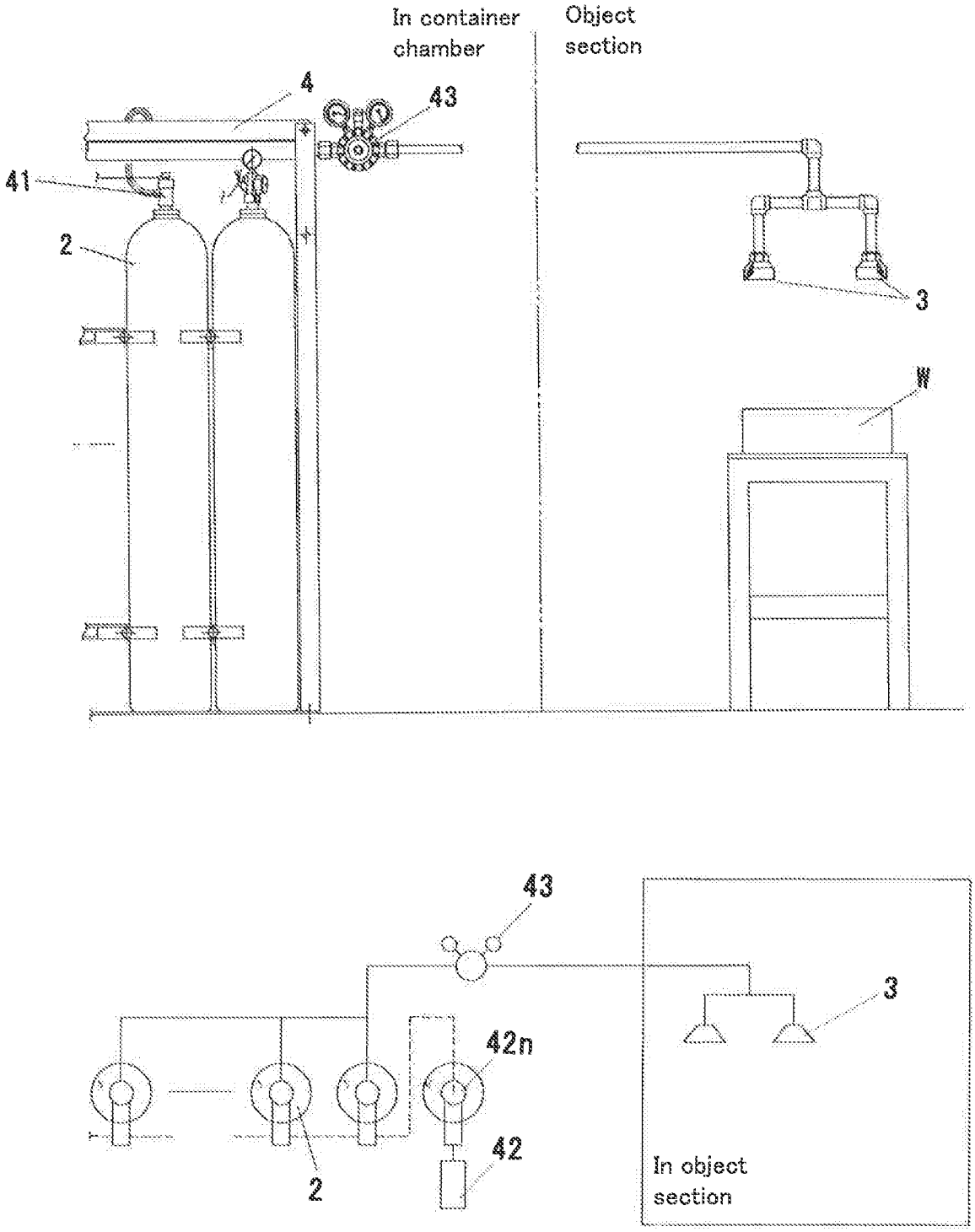
FIG. 13 Explanatory drawing to show Reference 1 of local fire-extinguishing equipment using the nozzle portion of the fire extinguisher of this invention.
Figure 14:
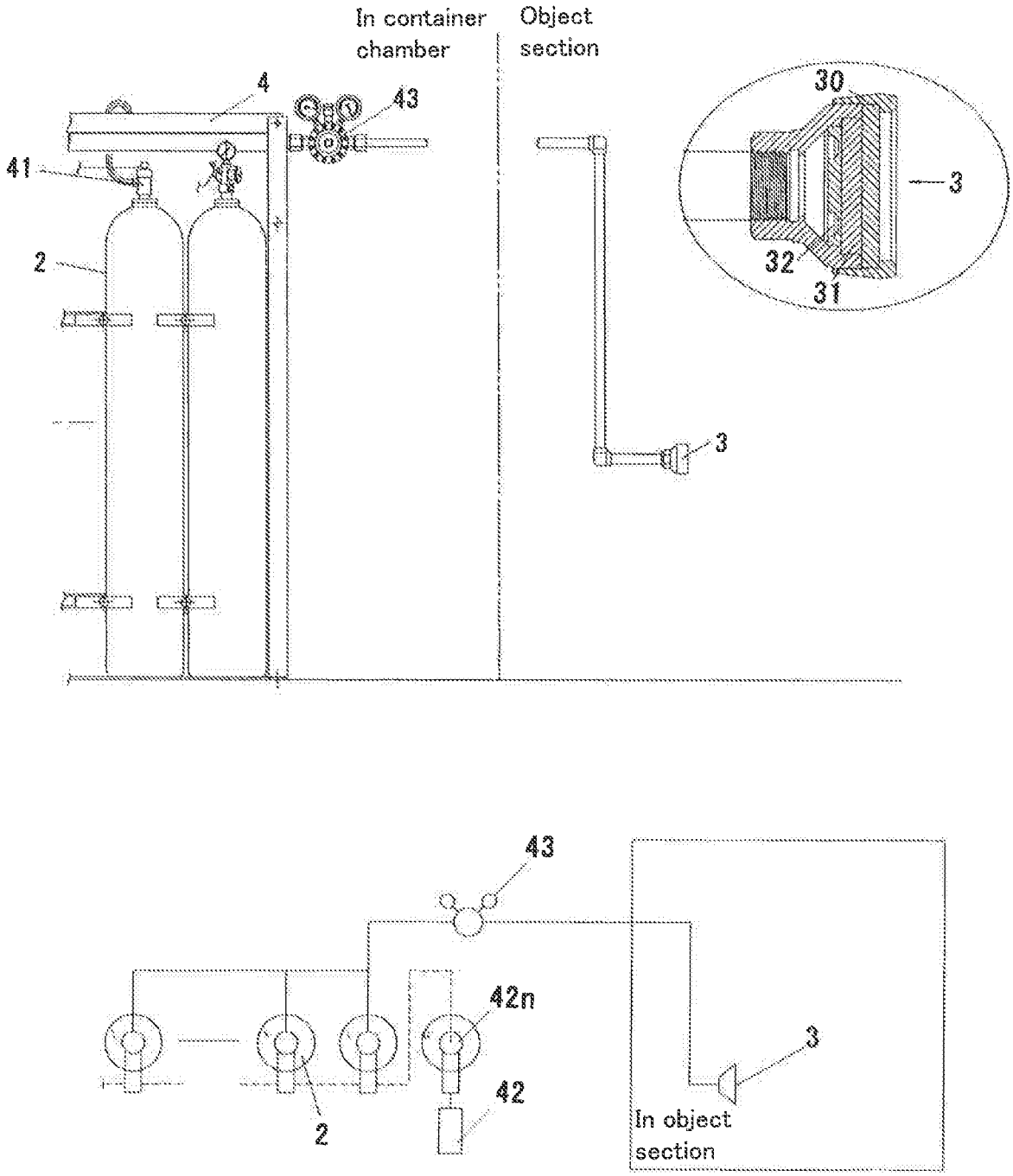
FIG. 14 Explanatory drawing to show Reference 2 of local fire-extinguishing equipment using the nozzle portion of the fire extinguisher of this invention.

As shown in the modification of Embodiment 5 of the fire extinguisher of this invention shown in FIG. 12, it is possible to install the metallic porous member 35 as to cover the outlet portion of all the nozzle portions 3 of the nobble portion 3A formed as the aggregate of the nozzle portion 3 using multiple pieces of nozzle portion 3.

This makes it possible to unify the nitrogen gas discharged from the nozzle portions 3 by the metallic porous member 35 to discharge toward the object to be extinguished.

In this embodiment, space 36 is formed between the nozzle portion 3 and metallic porous member 35, but it is also possible to set the nozzle portion 3 and metallic porous member 35 in contact with each other without providing the space.

By the way, the fire extinguisher of this invention has the purpose of providing a portable type or semi-fixed type fire extinguisher suitable for first-aid fire extinguishing in a relatively narrow range but it is also possible to provide fixed type local fire extinguishing equipment suitable for first-aid fire extinguishing against a particular object W or in a relatively narrow range as shown in FIG. 11 (Reference 1) and FIG. 12 (Reference 2) by using the nozzle portion 3 of the fire extinguisher 1 of this invention.

For the opening device 42, it is possible to use properly the constant pressure gas source 42*n* for starting (see Patent Literature 4).

The fire extinguisher of this invention has so far been explained in accordance with multiple embodiments, but this invention is not limited to the configuration described in the above embodiments, and the configuration can be changed within a range not deviated from the purpose by properly adopting known technologies or combining the configurations described in the embodiments as described in (1) through (3) below.

(1) As the fire extinguishing agent, in addition to the nitrogen gas, representative as inert gas, it is possible to use inert gases of multiple types mixing other inert gases such as argon including nitrogen gas. The fire-extinguishing agent can be stored in the agent storage container in the state of gas or liquid (the storage portion of the agent to the container volume can be increased in comparison with the gas. In this case, a container suitable for storing the liquefied gas is used). Also, as the fire-extinguishing agent, not only the inert gas, but also halon substitute not subject to the halon control (for example, HFC-227ea) can be used.

(2) As the agent storage container, in addition to the normally used chrome molybdenum, manganese and stainless steel seamless containers and aluminum container, light and strong titanium container and composite containers of liner material, high-pressure container portion reinforced with FRP such as glass fiber plastic and carbon fiber plastic can be used.

(3) As the fire-extinguishing agent supply means, in addition to the agent storage container, it is possible to use nitrogen generators disclosed in the patent gazette No. 10-263109 and 2007-222534 and the gas generator using the gas generating agent disclosed in the gazette No. 2001-346898.

FEASIBILITY OF INDUSTRIAL USE

The fire extinguisher of this invention uses as the fire-extinguishing agent the inert gas, etc. not restricted in the object to be extinguished and the method of use due to toxicity to human body and makes it easy to maintain the necessary concentration of the fire-extinguishing agent for extinguishing, thereby obtaining an effective fire-extinguishing effect, and therefore, this portable or semi-fixed type fire extinguisher suitable for first-aid fire extinguishing can be used for first-aid fire extinguishing for various types of electrical/electronic equipment such as computer, communication equipment, data center and electrical equipment.

EXPLANATION OF SIGNS

1 Fire extinguisher
2 Fire-extinguishing agent storage container (agent supply means)
3 Nozzle portion
3A Nozzle portions (aggregate of nozzle portions)
30 Nozzle body
31 Metallic porous member
32 Orifice plate
32*a* Orifice
33 Holding portion
34 Opening/closing valve
35 Metallic porous member
4 Controller
41 Container valve
42 Opening device
43 Adjuster
43*a* Flow route
43*b* Valve body
43*c* Valve support
43*d* Flow route opening portion
43*e* Gas pressure chamber
43*f* Passage
43*g* Spring member
44 Safety device
51 Protector
52 Fixing band
53 Shouldering device
54 Discharge direction indicator
6 Hose
61 Hose reel

The invention claimed is:

1. A fire extinguisher comprising:

a nozzle portion;

a fire-extinguishing agent supply means including an agent storage container;

a metallic porous member in an outlet portion of the nozzle portion; and a container valve arranged in an opening of the agent storage container, the container valve having formed therein a flow route of a gas type fire-extinguishing agent supplied from the fire-extinguishing agent supply means, the flow route extending from a first opening portion to a second opening portion, the first opening portion being connected to the nozzle portion, wherein the container valve includes an opening device arranged between the first and second opening portions, the opening device having a single movable opening/closing member configured to open and close the flow route, and an adjuster arranged entirely inside the agent storage container and connected to the second opening portion of the flow route, the adjuster having a constant flow valve, the constant flow valve having a valve body configured to move in a downward direction by a biasing force so as to increase a sectional area of the second opening portion, the valve body being configured to be moved in an upward direction by a force of a gas flow directly applied to the valve body so as to decrease the sectional area of the second opening portion, wherein the constant flow valve is configured to balance the biasing force applied to the valve body and the force of the gas flow directly applied to the valve body such that a flow rate of the gas flow through the sectional area of the second opening portion is held constant while discharging the gas type fire-extinguishing agent, wherein at least the nozzle portion is portable so as to discharge the gas type fire-extinguishing agent toward an object to be extinguished, wherein the metallic porous member is installed at an outlet portion of a flow route of the gas type fire-extinguishing agent formed in the nozzle portion, and wherein the metallic porous member includes an upstream porous member and a downstream porous member, the downstream porous member being arranged on a downstream side of the upstream porous member relative to the flow route, the downstream porous member having a larger diameter than that of the upstream porous member.

2. The fire extinguisher described in claim 1, wherein the nozzle portion is rigidly connected to the agent storage container, and the agent storage container is portable.

3. The fire extinguisher described in claim 1, wherein the nozzle portion is connected via a hose to the agent storage container, and the agent container is installed fixed.

4. The fire extinguisher described in claim 1, wherein the nozzle portion has an opening diameter of 50 mm or larger.

5. The fire extinguisher described in claim 2, wherein the nozzle portion has an opening diameter of 50 mm or larger.

6. The fire extinguisher described in claim 3, wherein the nozzle portion has an opening diameter of 50 mm or larger.

7. The fire extinguisher described in claim 1, wherein the gas type fire-extinguishing agent mainly consists of an inert gas.

8. The fire extinguisher described in claim 2, wherein the gas type fire-extinguishing agent mainly consists of an inert gas.

9. The fire extinguisher described in claim 3, wherein the gas type fire-extinguishing agent mainly consists of an inert gas.

10. The fire extinguisher described in claim 4, wherein the gas type fire-extinguishing agent mainly consists of an inert gas.

11. The fire extinguisher described in claim 5, wherein the gas type fire-extinguishing agent mainly consists of an inert gas.

12. The fire extinguisher described in claim 6, wherein the gas type fire-extinguishing agent mainly consists of an inert gas.

13. The fire extinguisher described in claim 1, wherein pores of the downstream porous member each have a diameter which is smaller than that of pores of the upstream porous member.

14. The fire extinguisher described in claim 1, further comprising an orifice plate having passages therethrough, wherein the upstream porous member is arranged adjacent to an outlet side of the orifice plate.

15. The fire extinguisher described in claim 1, further comprising an orifice plate having passages therethrough, each passage having a first opening on one side of the orifice plate and a second opening on an opposite side of the orifice plate, wherein each first opening has a diameter which is larger than that of each second opening, and wherein the orifice plate is arranged such that the second openings of the passages face the upstream porous member.

* * * * *